US010233929B2

(12) United States Patent
Nakai et al.

(10) Patent No.: US 10,233,929 B2
(45) **Date of Patent: *Mar. 19, 2019**

(54) ROTARY COMPRESSOR HAVING TWO CYLINDERS

(71) Applicant: Panasonic Intellectual Property Management Co., Ltd., Osaka (JP)

(72) Inventors: Hiroaki Nakai, Shiga (JP); Hirofumi Yoshida, Shiga (JP); Shingo Oyagi, Osaka (JP); Yu Shiotani, Osaka (JP); Tsuyoshi Karino, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 10 days.

This patent is subject to a terminal disclaimer.

(21) Appl. No.: 15/118,857

(22) PCT Filed: Jun. 8, 2015

(86) PCT No.: PCT/JP2015/002857

§ 371 (c)(1),
(2) Date: Aug. 13, 2016

(87) PCT Pub. No.: WO2015/198539

PCT Pub. Date: Dec. 30, 2015

(65) Prior Publication Data

US 2017/0167487 A1 Jun. 15, 2017

(30) Foreign Application Priority Data

Jun. 24, 2014 (JP) ..... 2014-128742

(51) Int. Cl.
*F03C 2/00* (2006.01)
*F03C 4/00* (2006.01)
(Continued)

(52) U.S. Cl.
CPC ..... *F04C 18/3564* (2013.01); *F04C 18/356* (2013.01); *F04C 18/44* (2013.01);
(Continued)

(58) Field of Classification Search
CPC .... F04C 18/3564; F04C 18/44; F04C 23/001; F04C 23/008; F04C 29/0057;
(Continued)

(56) References Cited

U.S. PATENT DOCUMENTS

2010/0147013 A1 6/2010 Hirayama

FOREIGN PATENT DOCUMENTS

| | | | |
|---|---|---|---|
| JP | 2012-036822 | A | 2/2012 |
| JP | 5117503 | B | 1/2013 |
| WO | 2009/028633 | A1 | 3/2009 |

OTHER PUBLICATIONS

International Search Report of PCT application No. PCT/JP2015/002857 dated Aug. 18, 2015.

(Continued)

*Primary Examiner* — Theresa Trieu
(74) *Attorney, Agent, or Firm* — Hamre, Schumann, Mueller & Larson, P.C.

(57) ABSTRACT

A rotary compressor having two cylinders includes crankshaft having first eccentric portion and second eccentric portion connected to each other by connecting portion. The rotary compressor further includes two compressive elements that compress working fluid in cylinder as first piston inserted over first eccentric portion eccentrically rotates in accordance with rotation of crankshaft. Further, first piston inserted over first eccentric portion undergoes assembly by being inserted over first eccentric portion through second eccentric portion. Further, a releasing portion is provided at each of outer diameter portions of first eccentric portion and second eccentric portion.

4 Claims, 9 Drawing Sheets

(51) Int. Cl.

| | |
|---|---|
| ***F04C 11/00*** | (2006.01) |
| ***F04C 18/356*** | (2006.01) |
| ***F04C 23/00*** | (2006.01) |
| ***F04C 29/00*** | (2006.01) |
| ***F04C 18/44*** | (2006.01) |

(52) U.S. Cl.
CPC ..... *F04C 23/00* (2013.01); *F04C 23/001* (2013.01); *F04C 29/00* (2013.01); *F04C 29/0057* (2013.01); *F04C 2240/20* (2013.01); *F04C 2240/60* (2013.01)

(58) Field of Classification Search
CPC ..... F04C 2240/20; F04C 2240/60; F04C 18/356; F04C 23/00; F04C 29/00
USPC ..... 418/11, 13, 60, 63, 150
See application file for complete search history.

(56) References Cited

OTHER PUBLICATIONS

English Translation of Chinese Search Report dated Mar. 23, 2018 for the related Chinese Patent Application No. 201580010210.1, 2 pages.
The Communication pursuant to Article 94(3) EPC dated Nov. 7, 2017 for the related European Patent Application No. 15811982.6.

ROTARY COMPRESSOR HAVING TWO CYLINDERS

This application is a U.S. national stage application of the PCT international application No. PCT/JP2015/002857 filed on Jun. 8, 2015, which claims the benefit of foreign priority of Japanese patent application No. 2014-128742 filed on Jun. 24, 2014, the contents all of which are incorporated herein by reference.

TECHNICAL FIELD

The present invention relates to a rotary compressor having two cylinders used for an air conditioner, a freezer, a blower, a water heater and the like.

BACKGROUND ART

In a freezing apparatus or an air conditioning apparatus, what is used is a compressor that suctions a gas refrigerant evaporated by an evaporator and compresses the refrigerant to a pressure required for the gas refrigerant to condense, and feeds the gas refrigerant of high temperature and high pressure into a refrigerant circuit. As such a compressor, a rotary compressor is known. Among others, a rotary compressor having two cylinders, in which two compression chambers are structured in the compressor, is actively developed as a high-performance compressor for its characteristics including low vibrations, low noises, and capability of high-speed operations. There is a demand for a compressor of higher capacity while being small in size.

Measures taken to increase the capacity of a rotary compressor include increasing the height of a cylinder thereby increasing the capacity, and increasing the amount of eccentricity of a crankshaft thereby increasing the containment capacity of a compression chamber.

In the case where the capacity is increased by increasing the height of the cylinder, the diameter of the crankshaft must be increased in order to address increased bearing loads. Thus, the efficiency of the compressor is disadvantageously reduced.

On the other hand, the case where any measures for increasing the amount of eccentricity of a crankshaft is employed for a rotary compressor having two cylinders is discussed. In general, the crankshaft of the rotary compressor having two cylinders is provided with eccentric portions at positions opposite from each other by 180°. Pistons are respectively inserted over the eccentric portions. The crankshaft itself is supported by a main bearing that mainly pivotally supports the crankshaft, and an auxiliary bearing that pivotally supports the crankshaft on the opposite side relative to the eccentric portions, and is smaller in diameter than the main bearing. When the amount of eccentricity of the crankshaft is increased, the counter-eccentric direction of the eccentric portion of the crankshaft is positioned inward than the diameter of the main shaft, making it impossible for the piston to be inserted. A scheme for avoiding such a problem uses the difference in diameter between a main shaft portion and an auxiliary shaft portion of the crankshaft. In the scheme, a first piston to be inserted over a first eccentric portion on the side nearer to the main shaft portion is caused to pass through the auxiliary shaft portion, a second eccentric portion on the side nearer to the auxiliary shaft portion, and a connecting portion, to be inserted over the first eccentric portion. Here, the connecting portion connects between the first eccentric portion and the second eccentric portion.

In such a case, a highly efficient compressor can be realized without excessively increasing the diameter of the eccentric shaft. Further, the main shaft portion whose diameter is greater can support the load on the two eccentric portions by a greater amount. However, also in such a case, an increase in the amount of eccentricity reduces the diameter of the connecting portion connecting between the two eccentric portions, whereby rigidity of the crankshaft reduces at the connecting portion. This increases the load on the auxiliary bearing whose diameter is smaller, causing a reduction in reliability.

In view of such problems, there is a need for measures against a reduction in rigidity of the connecting portion, while avoiding a reduction in efficiency of the compressor such as an increase in diameter of the main shaft portion, the auxiliary shaft portion, and the eccentric portion.

Addressing the problems, for example in a rotary compressor described in PTL 1, a raised portion is provided at a connecting portion in a dimensional range capable of being accommodated in a bevel at the inner surface of a piston, to increase rigidity of the connecting portion.

With the conventional structure, in order to largely increase rigidity of the connecting portion, measures such as increasing the beveling diameter at the inner surface of the piston must be taken. However, since an increase in the bevel of the piston in the radial direction influences airtightness of the compression chamber, the increase in the bevel is restricted. Accordingly, there is limit in increasing rigidity.

CITATION LIST

Patent Literature

PTL 1: Japanese Patent No. 5117503

SUMMARY

The present invention has been made to solve the conventional problems, and increases rigidity of a connecting portion without being dependent on the beveling diameter at the inner surface of a piston. Thus, the present invention provides a highly efficient and reliable rotary compressor without reducing the airtightness of a compression chamber.

In order to solve the conventional problems described above, a rotary compressor having two cylinders of the present invention includes: a crankshaft having a first eccentric portion and a second eccentric portion connected to each other by a connecting portion; and two compressive elements that compress working fluid in a cylinder as a first piston inserted over the first eccentric portion eccentrically rotates in accordance with rotation of the crankshaft. Further, the first piston inserted over the first eccentric portion undergoes assembly by being inserted over the first eccentric portion through the second eccentric portion. Further, a releasing portion is provided at each of outer diameter portions of the first eccentric portion and the second eccentric portion on the connecting portion side. Further, $Hc\text{-}c<Hp-Hpc<Hc\text{-}c+Hcd<Hp$ is established where Hc-c is a height of the connecting portion, Hcd is a height of the releasing portions, Hp is a height of the first piston, and Hpc is a height of one of bevels provided at both surfaces of the first piston. Further, an outermost diameter of a projection cross section obtained by overlaying a cross section of the first eccentric portion excluding the releasing portion and a cross section of the second eccentric portion excluding the releasing portion on each other is set to be greater than an inner diameter of the first piston.

Normally, as to the height of the connecting portion connecting between the two eccentric portions, a minimum limit height allowing insertion is determined depending on the height and shape of the piston which is inserted over. On the other hand, the present invention realizes a shorter height of the connecting portion than the conventional limit height by providing releasing portions on the outer diameter portions of the eccentric portions relative to the connecting portion. Accordingly, by virtue of the low rigidity site being short, rigidity of the whole crankshaft can be increased.

According to the present invention, even in the case where the amount of eccentricity of the compressor is great, a highly efficient and reliable rotary compressor can be implemented without reducing airtightness of the compression chamber.

DESCRIPTION OF PREFERRED EMBODIMENTS

Hereinafter, a description will be given of an exemplary embodiment of the present invention with reference to the drawings. Note that, the present invention is not limited by the exemplary embodiment.

Figure 1:
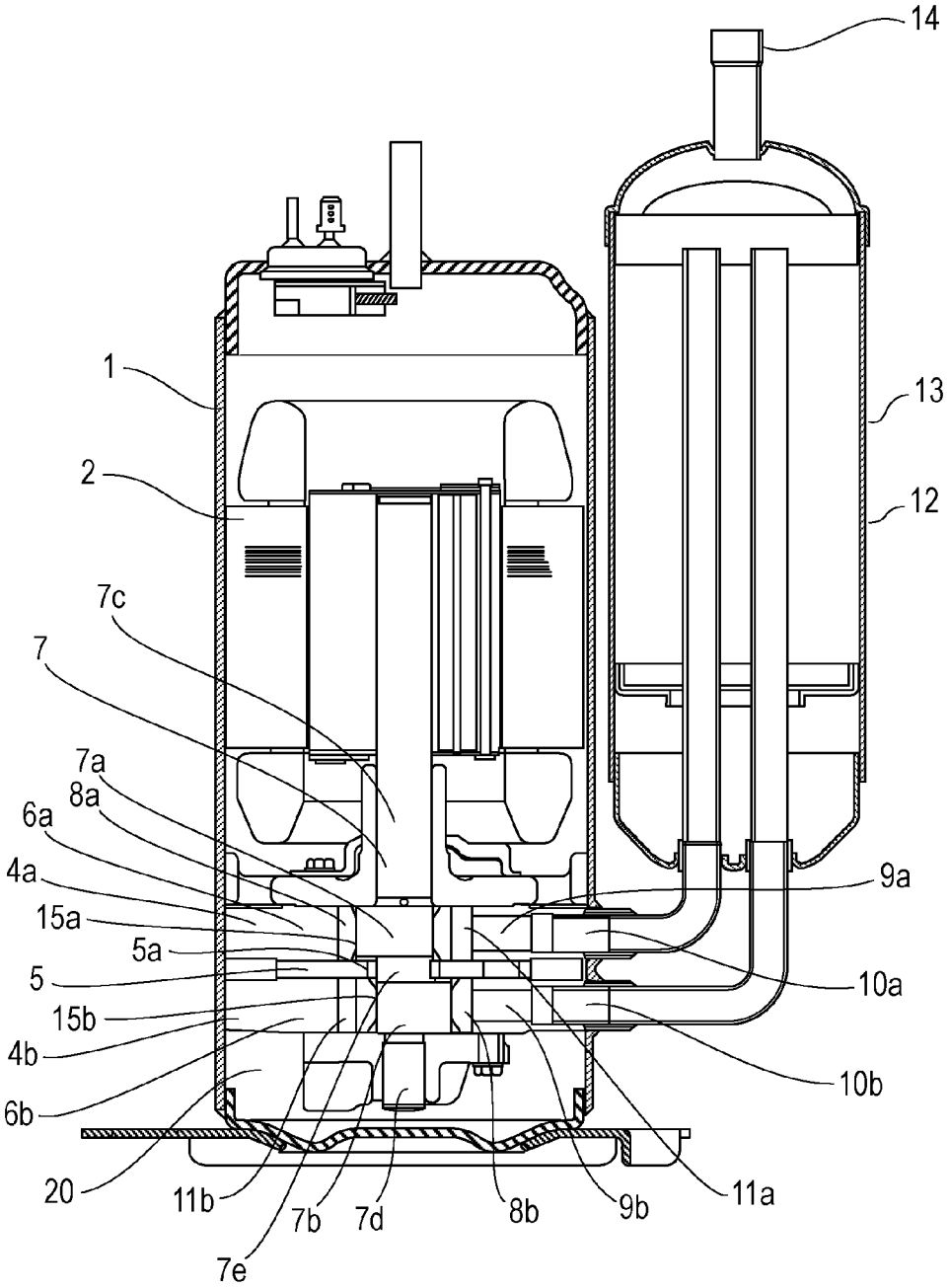
FIG. 1 is a vertical cross-sectional view of a rotary compressor according to an exemplary embodiment of the present invention.
Figure 2A:
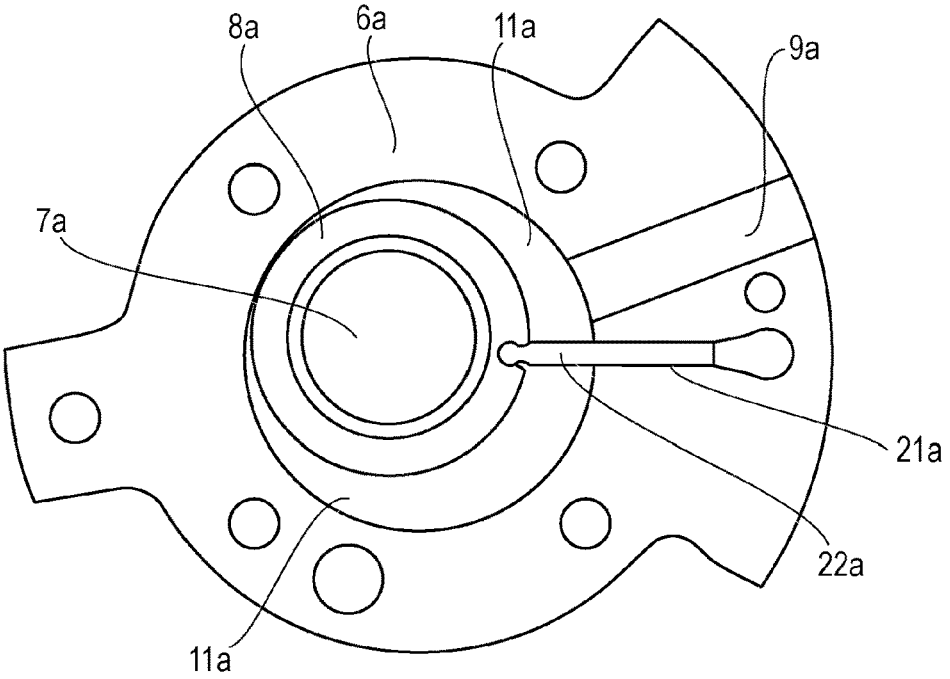
FIG. 2A is a plan view of a compressive element of the rotary compressor according to the exemplary embodiment of the present invention.
Figure 2B:
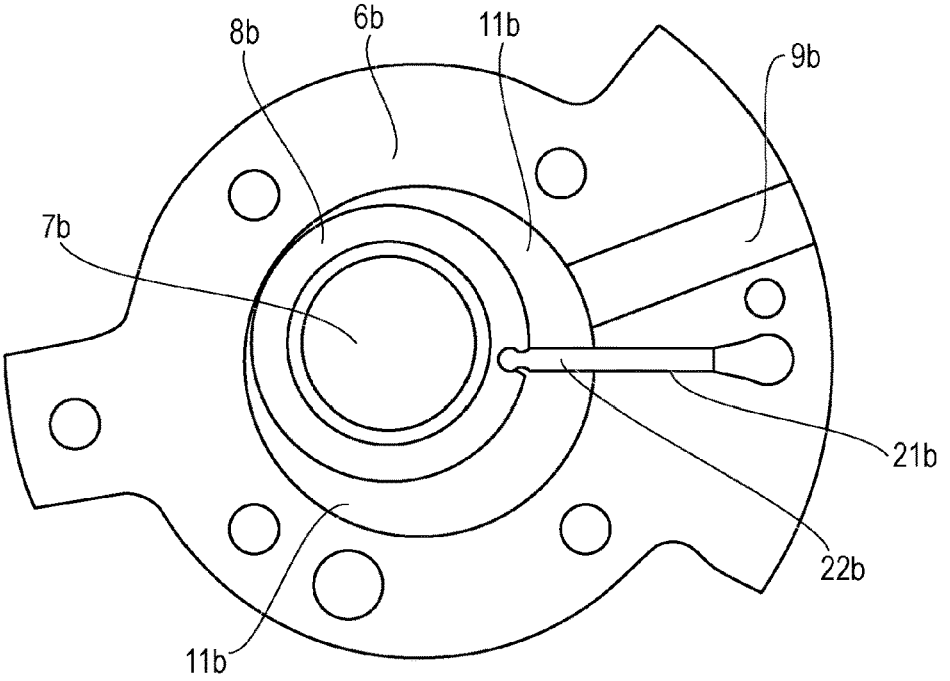
FIG. 2B is a plan view of the compressive element of the rotary compressor according to the exemplary embodiment of the present invention.

FIG. 1 is a vertical cross-sectional view of a rotary compressor according to an exemplary embodiment of the present invention. FIG. 2A is a plan view of a compressive element of the rotary compressor. FIG. 2B is a plan view of the compressive element of the rotary compressor.

In FIG. 1, sealed container 1 houses electrically-operated element 2 and compressive elements 4*a*, 4*b*. Electrically-operated element 2 rotates crankshaft 7. Crankshaft 7 drives compressive elements 4*a*, 4*b*.

Compressive elements 4*a*, 4*b* perform a compression operation independently of each other. Compressive element 4*a* has cylinder 6*a* that forms a cylindrical space, and first piston 8*a* disposed in cylinder 6*a*. Compressive element 4*b* has cylinder 6*b* that forms a cylindrical space, and second piston 8*b* disposed in cylinder 6*b*.

Crankshaft 7 is provided with first eccentric portion 7*a* and second eccentric portion 7*b*. Partition plate 5 is disposed between two compressive elements 4*a*, 4*b*. A main bearing is disposed on the electrically-operated element 2 side relative to compressive element 4*a*. The main bearing forms, with a bearing portion that pivotally supports main shaft portion 7*c*, an upper end plate. The upper end plate closes compressive element 4*a* on the electrically-operated element 2 side. An auxiliary bearing is disposed on the oil reservoir portion 20 side relative to compressive element 4*b*. The auxiliary bearing forms, with a bearing portion that pivotally supports auxiliary shaft portion 7*d*, a lower end plate. The lower end plate closes compressive element 4*b* on the oil reservoir portion 20 side.

Cylinder 6*a* is disposed at the upper surface of partition plate 5. Cylinder 6*b* is disposed at the lower surface of partition plate 5. Further, cylinder 6*a* houses first eccentric portion 7*a*. Cylinder 6*b* houses second eccentric portion 7*b*.

First eccentric portion 7*a*, second eccentric portion 7*b*, and connecting portion 7*e* are structured integrally with crankshaft 7. First piston 8*a* is mounted on first eccentric portion 7*a*. Second piston 8*b* is mounted on second eccentric portion 7*b*.

As shown in FIGS. 1, 2A and 2B, vane groove 21*a* is formed at cylinder 6*a*. At cylinder 6*b* also, vane groove 21*b* is formed. Vane 22*a* is slidably disposed at vane groove 21*a*. Vane 22*b* is slidably disposed at vane groove 21*b*. Vane 22*a* is constantly coupled to first piston 8*a*. When first piston 8*a* oscillates in accordance with the rotation of crankshaft 7, vane 22*a* reciprocates in vane groove 21*a* in accordance with the movement of first piston 8*a*. First piston 8*a* is structured so as to avoid independent rotation, by being coupled or integrated with vane 22*a* that oscillates in cylinder 6*a*. Suction passage 9*a* is provided at cylinder 6*a*. Suction passage 9*b* is provided at cylinder 6*b*. Suction pipe 10*a* is connected to suction passage 9*a*. Suction pipe 10*b* is connected to suction passage 9*b*. Suction passage 9*a* and suction passage 9*b* are independent of each other. Suction pipe 10*a* and suction pipe 10*b* are independent of each other. Suction pipe 10*a* communicates with compression chamber 11*a* through suction passage 9*a*. Suction pipe 10*b* communicates with compression chamber 11*b* through suction passage 9*b*.

Further, in order to prevent liquid compression in compression chambers 11*a*, 11*b*, accumulator 12 is provided for suction pipes 10*a*, 10*b*. Accumulator 12 separates refrigerant into gas and liquid, and guides only refrigerant gas to suction pipes 10*a*, 10*b*. In connection with accumulator 12, refrigerant gas introducing pipe 14 is connected to the upper portion of cylindrical case 13 and two refrigerant gas delivering pipes 15*a*, 15*b* are connected to the lower portion. One ends of refrigerant gas delivering pipes 15*a*, 15*b* are respectively connected to suction pipes 10*a*, 10*b*, and other ends of refrigerant gas delivering pipes 15*a*, 15*b* extend to the upper portion of the inner space of case 13.

When electrically-operated element 2 rotates crankshaft 7, first eccentric portion 7*a* and second eccentric portion 7*b* eccentrically rotate in cylinders 6*a*, 6*b*, and first piston 8*a* and second piston 8*b* rotate while causing vanes 22*a*, 22*b* to reciprocate. First piston 8*a* and second piston 8*b* repeatedly cause, at a cycle shifted by half a rotation from each other, suction and compression of refrigerant gas in cylinders 6*a*, 6*b*. The refrigerant of a low pressure suctioned from refrigerant gas introducing pipe 14 is separated into gas and liquid in case 13. The refrigerant gas from which liquid refrigerant has been separated passes through refrigerant gas delivering pipes 15*a*, 15*b*, suction pipes 10*a*, 10*b*, and suction passages 9*a*, 9*b*, and suctioned into compression chambers 11*a*, 11*b*.

Further, lubrication oil in oil reservoir portion 20 at the bottom portion of sealed container 1 is supplied from the lower end of auxiliary shaft portion 7*d* to through hole 5*a* via the inside of crankshaft 7, so that a region surrounded by partition plate 5, first piston 8*a*, second piston 8*b*, and crankshaft 7 is filled with the lubrication oil.

Hereinafter, a description will be given of the operation and effect of the rotary compressor having two cylinders in the above-described structure.

Figure 3:
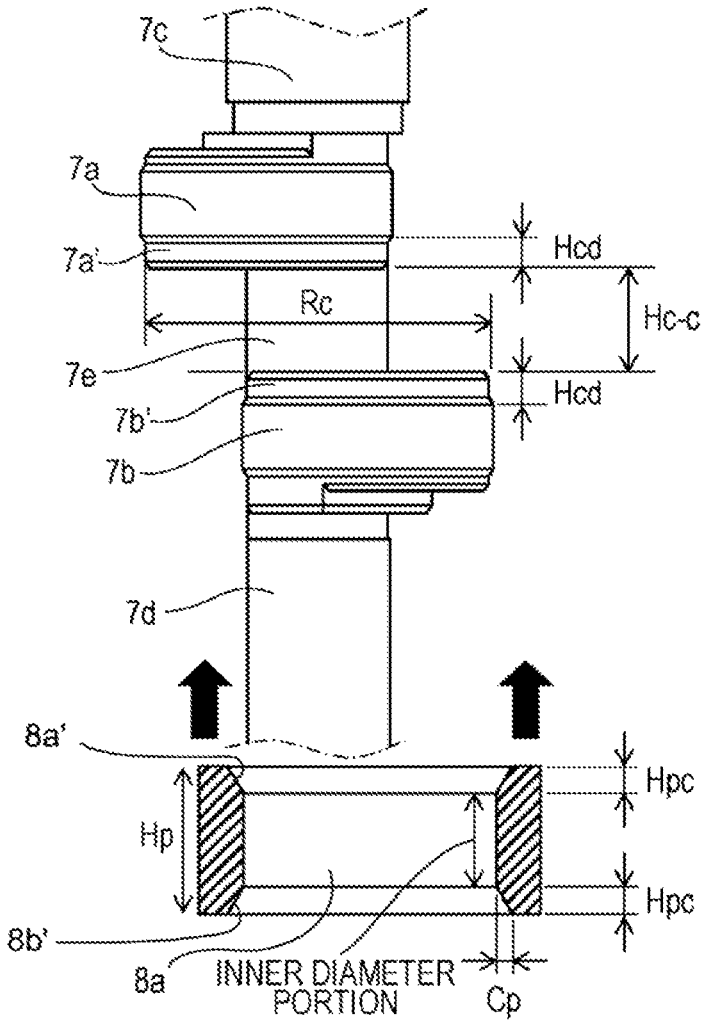
FIG. 3 is a main part side view showing the positional relationship of a crankshaft and a first piston of the rotary compressor during assembly according to the exemplary embodiment of the present invention.
Figure 4:
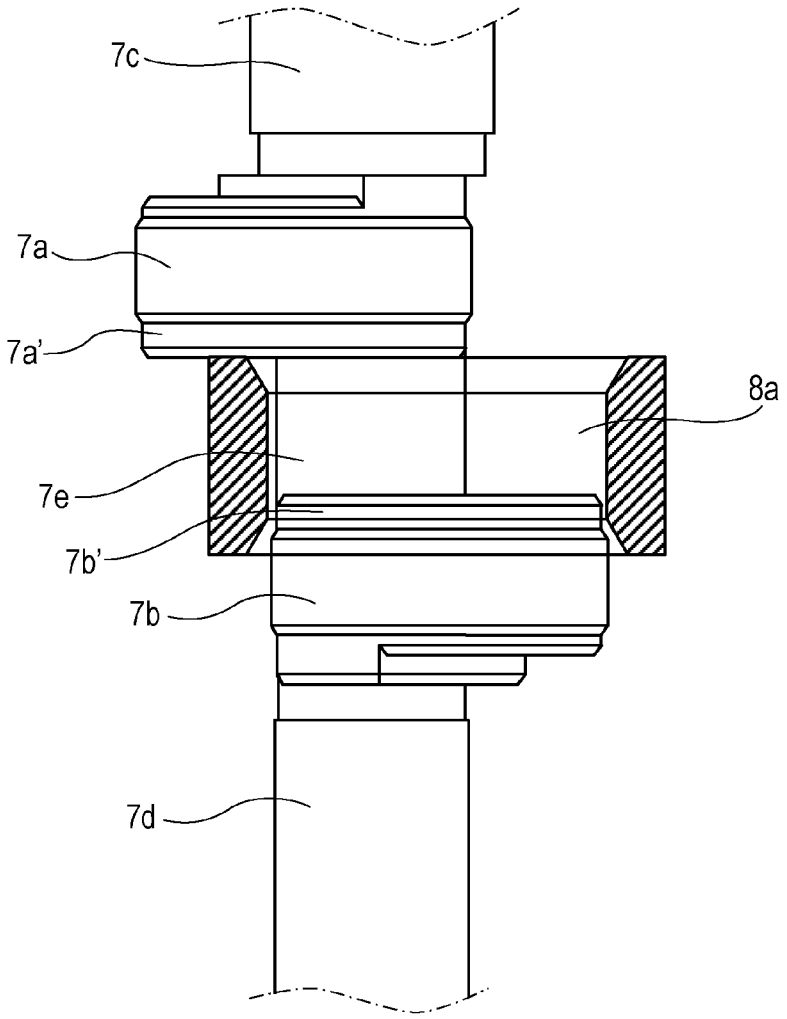
FIG. 4 is a main part side view showing the positional relationship of the crankshaft and the first piston of the rotary compressor during assembly according to the exemplary embodiment of the present invention.
Figure 5:
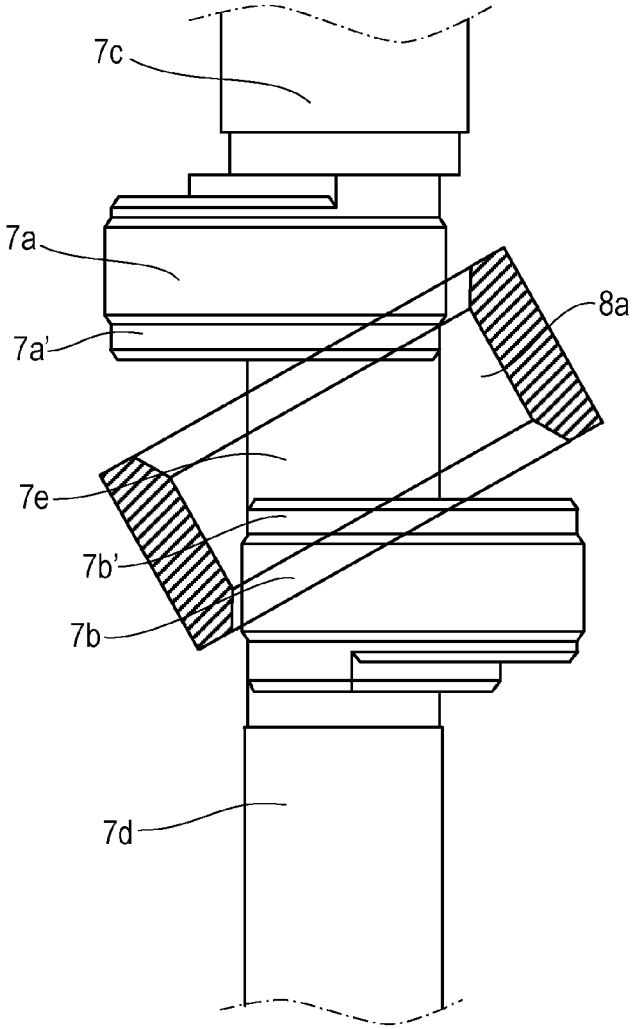
FIG. 5 is a main part side view showing the positional relationship of the crankshaft and the first piston of the rotary compressor during assembly according to the exemplary embodiment of the present invention.
Figure 6:
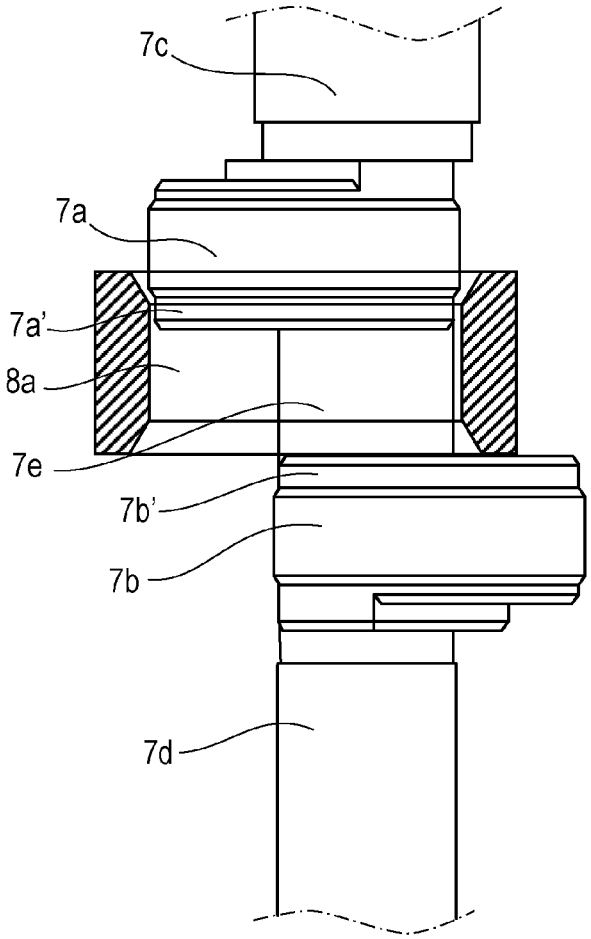
FIG. 6 is a main part side view showing the positional relationship of the crankshaft and the first piston of the rotary compressor during assembly according to the exemplary embodiment of the present invention.
Figure 7:
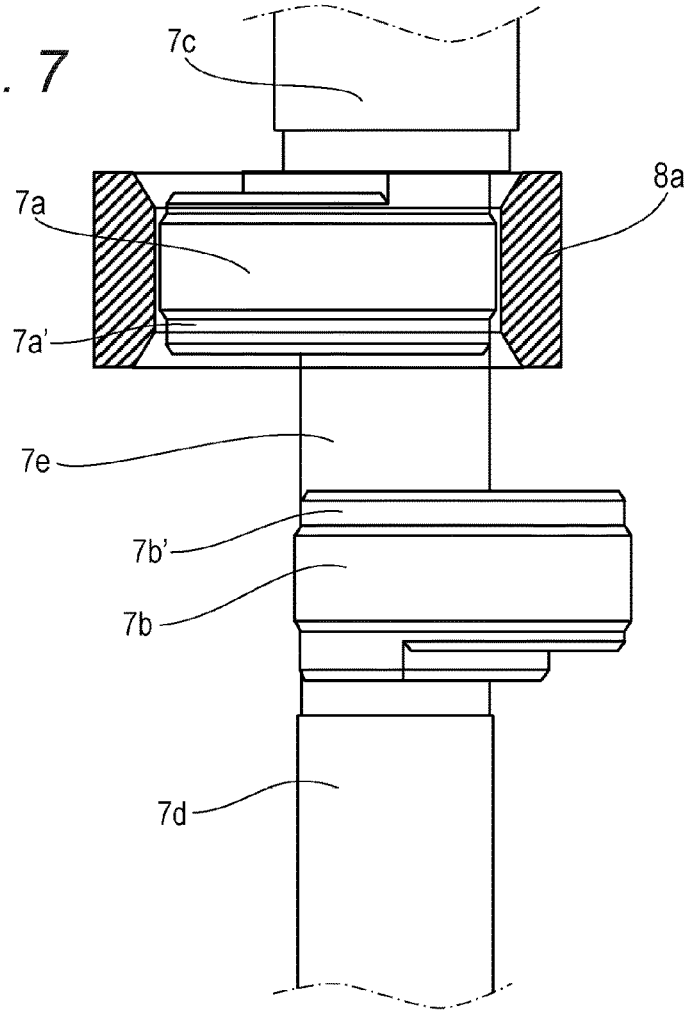
FIG. 7 is a main part side view showing the positional relationship of the crankshaft and the first piston of the rotary compressor during assembly according to the exemplary embodiment of the present invention.

FIG. 3 is a main part side view showing the positional relationship of the crankshaft and the first piston of the rotary compressor during assembly according to the exemplary embodiment of the present invention. FIG. 4 is a main part side view showing the positional relationship of the crankshaft and first piston of the rotary compressor during assembly. FIG. 5 is a main part side view showing the positional relationship of the crankshaft and the first piston of the rotary compressor during assembly. FIG. 6 is a main part side view showing the positional relationship of the crankshaft and the first piston of the rotary compressor. FIG. 7 is a main part side view showing the positional relationship of the crankshaft and the first piston of the rotary compressor during assembly. The assembly of the crankshaft and the first piston of the rotary compressor is performed in order of FIGS. 3, 4, 5, 6, and 7.

In assembly, as shown in FIG. 3, first piston 8*a* is inserted from the auxiliary shaft portion 7*d* side, to pass through second eccentric portion 7*b* and connecting portion 7*e*. As shown in FIG. 4, first piston 8*a* is inserted until its upper end is brought into contact with the lower end of first eccentric portion 7*a*. Thus, the inner diameter portion of first piston 8*a* is inserted to cover connecting portion 7*e* and releasing portion 7*b*' of second eccentric portion 7*b*.

Here, releasing portion 7*b*' is structured by a step portion which is concentric to second eccentric portion 7*b* and with a reduced outer diameter. Thus, releasing portion 7*b*' can be formed simultaneously with processing of the eccentric shaft, and a reduction in diameter can be suppressed to a minimum.

Figure 8:
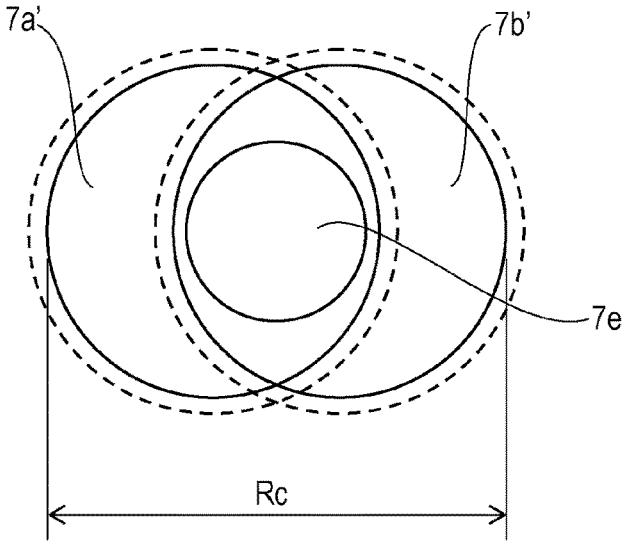
FIG. 8 is a projection of two eccentric portions of the rotary compressor according to the exemplary embodiment of the present invention.

FIG. 8 is a projection of two eccentric portions of the rotary compressor according to the exemplary embodiment of the present invention. As shown in FIG. 8, the rotary compressor according to the present exemplary embodiment is structured such that outermost diameter Re of a projection cross section, which is obtained by overlaying a cross section of first eccentric portion 7*a* and that of second eccentric portion 7*b* excluding releasing portion 7*a*' of first eccentric portion 7*a* and releasing portion 7*b*' of second eccentric portion 7*b* on each other, is greater than the inner diameter of first piston 8*a*. Accordingly, unless the inner diameter portion of first piston 8*a* is completely extracted from second eccentric portion 7*b*, first piston 8*a* cannot be inserted over first eccentric portion 7*a*. Hence, as shown in FIG. 5, as the next insert operation, by first piston 8*a* rotating and shifting in parallel, first piston 8*a* can be completely extracted from second eccentric portion 7*b*.

Further, in FIG. 3, Hc-c<Hp−Hpc<Hc-c+Hcd<Hp is established where Hc-c is the height of connecting portion 7*e*, Hcd is the height of releasing portions 7*a*' and 7*b*', Hp is the height of first piston 8*a*, and Hpc is the height of one of bevels 8*a*' and 8*b*' provided at opposite surfaces of first piston 8*a*. Accordingly, providing releasing portions 7*a*' and 7*b*' respectively to the outer diameter portions of first eccentric portion 7*a* and second eccentric portion 7*b* on the connecting portion 7*e* side realizes a shorter height of the connecting portion than the conventional piston insertion-allowed limit.

Note that, in connection with the inner surface bevels of first piston 8*a* of the rotary compressor according to the present exemplary embodiment, in order to facilitate shifting to a piston rotation operation, bevel height Hpc in the axial direction is set to be greater than bevel width Cp in the radial direction. Thus, by this amount, connecting portion 7*e* can be further shortened and rigidity can be increased, without impairing the sealing performance relative to the compression chamber via the end surface of first piston 8*a*.

In FIG. 6, the operation shown in FIG. 4 is performed symmetrically. Ultimately, as shown in FIG. 7, first piston 8*a* is completely inserted over first eccentric portion 7*a*.

Figure 9:
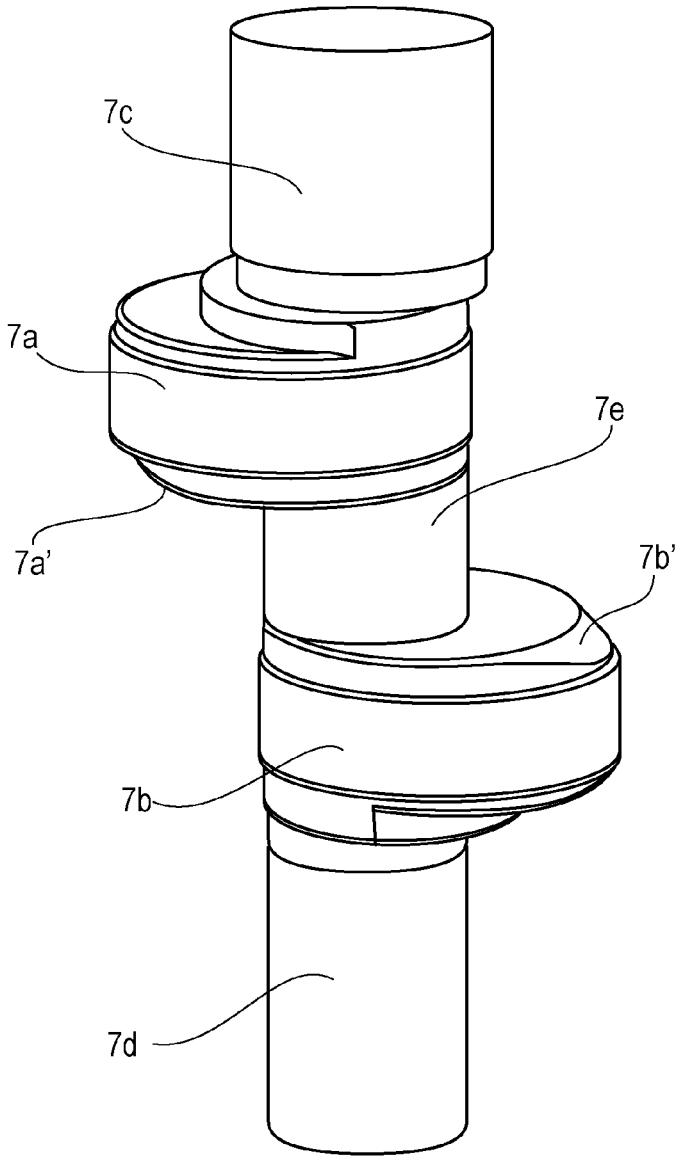
FIG. 9 is an explanatory diagram showing bevel shapes of the eccentric portions in the eccentric direction of the rotary compressor according to the exemplary embodiment of the present invention.
Figure 10:
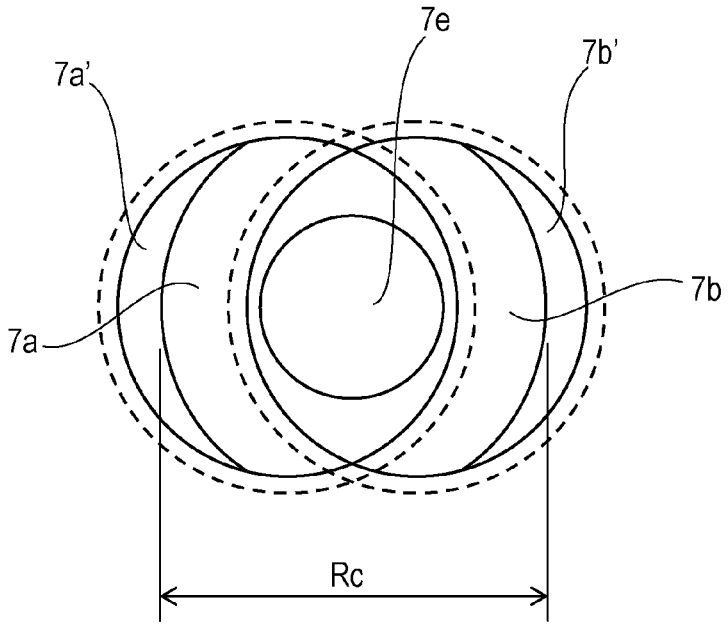
FIG. 10 is a projection of two eccentric portions including the bevel shapes of the eccentric portions in the eccentric direction of the rotary compressor according to the exemplary embodiment of the present invention.

Further, releasing portion 7*a*' of first eccentric portion 7*a* and releasing portion 7*b*' of second eccentric portion 7*b* may be in a manner other than that shown in FIGS. 3 to 7. That is, as shown in FIGS. 9 and 10, the sites of first eccentric portion 7*a* and second eccentric portion 7*b* in the eccentric direction may be largely beveled as compared to other sites. In this case also, the assembly procedure is the same as that described above. However, by providing great bevels in the eccentric direction, the inner surface of first piston 8*a* becomes less prone to be caught by the eccentric portion in the eccentric direction when transiting from the state shown in FIG. 9 to the rotation operation. Further, also when connecting portion 7*e* is reduced to a limit height, the assembly operation can be smoothly performed.

As described above, the rotary compressor having two cylinders according to the present exemplary embodiment includes crankshaft 7 having first eccentric portion 7*a* and second eccentric portion 7*b* connected to each other by connecting portion 7*e*. The rotary compressor further includes two compressive elements 4*a*, 4*b* that compress working fluid in cylinder 6*a* as first piston 8*a* inserted over first eccentric portion 7*a* eccentrically rotates in accordance with rotation of crankshaft 7. Further, first piston 8*a* inserted over first eccentric portion 7*a* undergoes assembly by being inserted over first eccentric portion 7*a* through second eccentric portion 7*b*. Further, releasing portions 7*a*', 7*b*' are respectively provided at outer diameter portions of first eccentric portion 7*a* and second eccentric portion 7*b* on the connecting portion 7*e* side. Further, Hc-c<Hp−Hpc<Hc-c+Hcd<Hp is established, where Hc-c is the height of the connecting portion 7*e*, Hcd is the height of releasing portions 7*a*', 7*b*', Hp is the height of first piston 8*a*, and Hpc is the height of one of bevels provided at both surfaces of first piston 8*a*. Still further, the outermost diameter of a projection cross section, which is obtained by overlaying a cross section of first eccentric portion 7*a* and a cross section of second eccentric portion 7*b* excluding releasing portions 7*a*', 7*b*' on each other, is set to be greater than the inner diameter of first piston 8*a*.

Accordingly, providing releasing portions 7*a*', 7*b*' respectively at the outer diameter portions of first eccentric portion 7*a* and second eccentric portion 7*b* on the connecting portion 7*e* side realizes a shorter height of connecting portion 7*e* than the conventional piston insertion-allowed limit. Hence, any low-rigidity portion in crankshaft 7 can be reduced to a minimum, and the increased rigidity provides both increased reliability and ensured airtightness of the rotary compressor.

Further, releasing portions 7*a*', 7*b*' are respectively structured by step portions being concentric to first eccentric portion 7*a* and second eccentric portion 7*b* and having reduced outer diameters. Thus, releasing portions 7*a*', 7*b*' can be formed simultaneously with processing of the eccentric shaft, and a reduction in diameter can be suppressed to a minimum. Accordingly, crankshaft 7 of higher rigidity can be structured.

Further, bevel 8*a*' of first piston 8*a* is structured to be greater in the axial direction than in the radial direction. Thus, increasing the height of bevel 8*a*' of first piston 8*a* enables to increase the rigidity of crankshaft 7 by further reducing the height of connecting portion 7*e*. Further, it also enables to ensure airtightness of compression chambers 11*a*, 11*b*.

Further, in releasing portions 7*a*', 7*b*', the sites of first eccentric portion 7*a* and second eccentric portion 7*b* in the eccentric direction are largely beveled as compared to other sites. Thus, also in the case where the height of connecting portion 7*e* is reduced to a minimum, when first piston 8*a* is inserted from second eccentric portion 7*b* to connecting portion 7*e*, and from connecting portion 7*e* to first eccentric portion 7*a*, first piston 8*a* can pass through without being caught by any edge portions of the eccentric portions in the eccentric direction. Accordingly, insertion in assembly can be facilitated.

Further, first piston 8*a* is structured so as to avoid independent rotation, by being coupled or integrated with vane 22*a* that oscillates in cylinder 6*a*. Thus, the piston is restrained by vane 22*a* from independently rotating, even in the case where first eccentric portion 7*a* and second eccentric portion 7*b* rotate in accordance with rotation of crankshaft 7 in a compression operation. Accordingly, first eccentric portion 7*a* and second eccentric portion 7*b* can pivotally support the piston forcibly at high relative speeds. Hence, the height of releasing portions 7*a*', 7*b*' can be increased by an increased bearing modulus. In accordance therewith, the height of connecting portion 7*e* can be further reduced, to increase rigidity of crankshaft 7.

INDUSTRIAL APPLICABILITY

As has been described above, the rotary compressor of the present invention can shorten, as compared to the conventional manner, the connecting portion of the crankshaft on the side near the main shaft portion over which the piston must be inserted from the auxiliary shaft portion. This realizes increased rigidity of the crankshaft and improved reliability of the highly efficient compressor. Hence, the rotary compressor of the present invention is useful as an air conditioner-use compressor using an HFC (Hydro Fluoro Carbon)-based refrigerant or the like as working fluid, or for an air conditioner or a heat pump water heater using $CO_2$ being a natural refrigerant.

The invention claimed is:

1. A rotary compressor having two cylinders, the compressor comprising:

a crankshaft having a first eccentric portion and a second eccentric portion connected to each other by a connecting portion; and two compressive elements that compress working fluid in cylinders as a first piston inserted over the first eccentric portion eccentrically rotates in accordance with rotation of the crankshaft, wherein the first piston inserted over the first eccentric portion undergoes assembly by being inserted over the first eccentric portion through the second eccentric portion, a first releasing portion is provided at an outer diameter portion of the first eccentric portion, a second releasing portion is provided at an outer diameter portion of the second eccentric portion, the first releasing portion being positioned on a side of the outer diameter portion of the first eccentric portion close to the connecting portion, the second releasing portion being positioned on a side of the outer diameter portion of the second eccentric portion close to the connecting portion, the first and the second releasing portions being structured by step portions, each of the first and the second releasing portions being concentric to the first eccentric portion and the second eccentric portion respectively, and the first and the second releasing portions having a reduced outer diameter relative to the first eccentric portion and the second eccentric portion respectively, $Hc\text{-}c<Hp-Hpc<Hc\text{-}c+Hcd<Hp$ is established where Hc-c is a height of the connecting portion, Hcd is a height of the first releasing portion or the second releasing portion, Hp is a height of the first piston, and Hpc is a height of one of bevels respectively provided at both surfaces of the first piston, and an outermost diameter of a projection cross section obtained by overlaying a cross section of the first eccentric portion excluding the first releasing portion and a cross section of the second eccentric portion excluding the second releasing portion on each other is set to be greater than an inner diameter of the first piston.

2. The rotary compressor according to claim 1, wherein the bevels of the first piston are each structured to be greater in an axial direction than in a radial direction.

3. The rotary compressor according to claim 1, wherein, in the first and the second releasing portions, respective eccentric sites of the first eccentric portion and the second eccentric portion are largely beveled as compared to other sites of the first eccentric portion and the second eccentric portion.

4. The rotary compressor according to claim 1, wherein the first piston is structured so as to avoid independent rotation, by being coupled or integrated with a vane that oscillates in the cylinder.

* * * * *